United States Patent [19]

Stone

[11] 4,250,717

[45] Feb. 17, 1981

[54] REFRIGERATION APPARATUS

[76] Inventor: Cyril O. Stone, 3145 Adanac St., Vancouver, British Columbia, Canada, V5K 2N8

[21] Appl. No.: 39,104

[22] Filed: May 15, 1979

[51] Int. Cl.[3] ..... F25B 47/00; F28D 5/00

[52] U.S. Cl. ..... 62/279; 62/305

[58] Field of Search ..... 62/279, 305

[56] References Cited

U.S. PATENT DOCUMENTS

| | | | |
|---|---|---|---|
| 1,537,601 | 5/1925 | Groh | 62/279 |
| 1,975,859 | 10/1934 | Nelson | 62/279 |
| 2,046,314 | 7/1936 | Benkly | 62/279 |
| 2,234,753 | 3/1941 | Frazer | 62/279 |
| 2,626,509 | 1/1953 | Morrison | 62/279 |
| 2,667,765 | 2/1954 | Harris et al. | 62/279 X |
| 2,911,801 | 11/1959 | Buehler, Jr. | 62/305 |
| 3,908,393 | 9/1975 | Eubank | 62/305 |
| 4,028,906 | 6/1977 | Gingold et al. | 62/305 X |

*Primary Examiner*—Lloyd L. King
*Attorney, Agent, or Firm*—Carver & Company

[57] ABSTRACT

Apparatus for utilizing waste water from a refrigeration system to cool the motor-compressor and associated coil of condenser tubing in that system. The apparatus features a motor-compressor around which is wrapped the condenser coil. The motor-compressor and condenser coil are contained within a water tank to which is directed waste water that has been collected from the meltdown of an ice making cycle or the condensate from a refrigerant evaporator. In applications where waste water production is insufficient a valve controlled supply of fresh water can be substituted therefor or used in conjunction with the waste water to effect cooling of both the compressor and condenser coils. Use of the waste water in this manner obviates the need for fans and associated motors to provide air-cooling of the condenser and for possible oil cooling of the motor-compressor.

4 Claims, 1 Drawing Figure

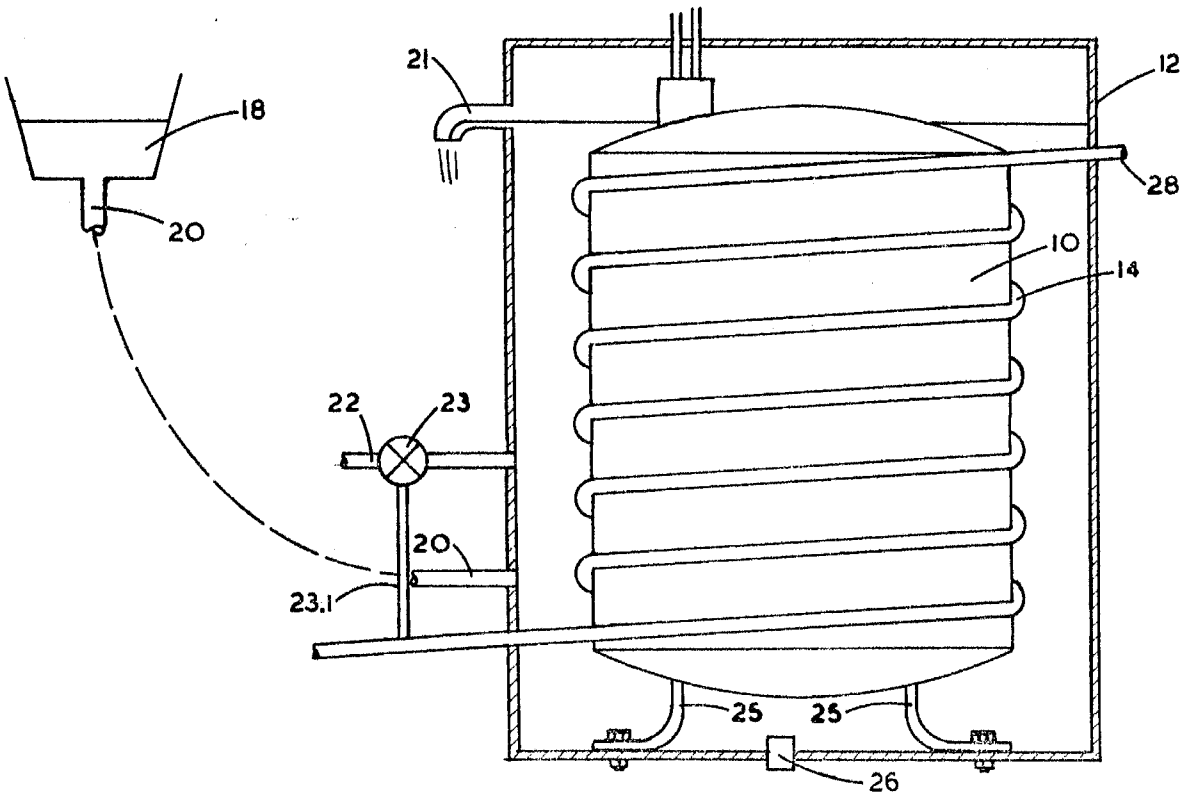
12
28
14
10
26
25
25
21
23
20
22
23.1
18
20

REFRIGERATION APPARATUS

BACKGROUND OF THE INVENTION

1. Field of the Invention

This invention relates to a waste water condenser which utilizes waste water obtained from the refrigeration system in cooling both the condenser coil and the compressor.

2. Prior Art

In conventional refrigeration systems a fan and accompanying fan motor are generally used to provide air-cooling for the condenser. However, this arrangement means that power must be supplied to the motor which drives the fan, thus incurring additional operating expense not to mention the increased chance of malfunction by reason of the need for additional moving parts. Moreover, since many refrigeration systems are located in an indoor environment where the air temperature is in the area of 70° F. the air used to cool the condenser is not very efficient in extracting heat from the refrigerant within the condenser coil. Additionally, the use of fans requires ventilation grilles in the appliances in which they are used. Other systems of cooling which use water for that purpose rather than air generally require a large amount of water which is in short supply in many areas.

SUMMARY OF THE INVENTION

The present invention involves a refrigeration system having a motor-compressor and associated coil of condenser tubing which utilizes waste water obtained either as meltdown water resulting from an ice making cycle or as condensate from a refrigerant evaporator as the coolant for the condenser coil. The cooling waste water is contained within a water tank which also houses the motor-compressor and the coil of condenser tubing wound around the motor-compressor. At or above the top of the motor-compressor there is located an overflow line in the water tank. Supplying waste water to the water tank is a waste water reservoir connected thereto by a suitable conduit so as to provide a suitable source of waste water at a pressure which allows the refrigerant pressure to be maintained at reasonable levels.

Utilizing waste water in this way obviates the need for an air fan and associated motor as well as providing for more efficient means for cooling the condenser. In addition, by utilizing waste water which is normally discharged from the system unused the overall system efficiency is increased. Obviously, the utility of the invention is restricted to refrigeration systems which generate a sufficient supply of waste water. The invention is particularly useful for those units which have ice making cycles or which are employed in drinking fountain modules.

The detailed description following, related to drawings, gives exemplification of preferred embodiments of the invention, which however is capable of expression in means other than that described and illustrated.

DESCRIPTION OF THE DRAWINGS

The FIGURE is a schematic elevation, partially in section, of the system of the invention.

DETAILED DESCRIPTION

The refrigeration system shown in the drawing consists of a water tight motor-compressor unit 10 and surrounding helical coil of condenser tubing 14 housed within a water tank 12. Positioned generally above the water tank 12 is a waste water reservoir 18, the bottom of which is connected by means of a waste water conduit 20 to the lower end of the water tank 12. The tank also has an overflow outlet 21.

Fresh water from a pressurized source of fresh water, such as a city main, is admitted into the water tank 12 through a fresh water conduit 22, rate of flow of water therethrough being controlled by a conventional water pressure regulating control valve 23. This valve is of the type in which the operation between open and closed positions is governed by the pressure of refrigerant in the condenser, pressure line from high side of condenser tubing to valve 23 being accorded the numeral 23.1. In this particular case, the valve 23 is adjusted so that it will open to allow the admission of fresh water into the tank when the pressure of refrigerant in the system rises above a reasonable level. The condenser coil 14 attaches at its upper end to the compressor discharge port 28 and is directed through a gland in the lower end of the water tank 12 to an evaporator, not shown in the drawing. The motor-compressor is mounted by means of mounting feet 25 to the bottom of the water tank 12. Also located at the bottom of the water tank 12 is a drain plug 26.

In operation the water tank 12 is first filled with water either manually or through the fresh water conduit 22. The fresh water conduit 22 would normally be connected to an external regulated supply of fresh water only where the system produces insufficient waste water. The water level 30 in the water tank 12 will rise to the level of the overflow outlet 24 at which point water will drain out of the tank. Thereafter, waste water obtained either as meltdown water resulting from an ice making cycle or as condensate from a refrigerant evaporator is collected and stored in a waste water reservoir 18, the bottom of which is generally above the level of the overflow outlet 21 in order to provide a sufficient water pressure to enable the level of water 30 within the water tank 12 to be maintained at the preselected level.

The provision of the fresh water inlet system which is controlled by the pressure of refrigerant, will maintain a minimum flow of water through the tank. A continuous flow of water is desirable in order to avoid bacterial build-up within the water and consequent scumming and fouling of the motor-compressor 10, the condenser coils 14 and water passages. In the event it is necessary to drain the water tank 12, a drain plug 26 is provided at the bottom of the water tank 12. Refrigerant which has been compressed and discharged from the compressor 10 through the compressor discharge port 28 located near the top of the motor-compressor 10 enters the condenser coils 14 which are cooled by the surrounding waste water within the water tank 12.

It is seen that refrigerant after compression enters the condenser coil 14 in the vicinity of the top of the water tank 12 and after being cooled is directed out of the water tank 12 by the condenser coil 14 which passes through a gland in the vicinity of the bottom of the water tank 12. The foregoing cycle in combination with the cycle of cooling water entering the water tank 12 generally in the vicinity of the bottom of the water tank 12 and being discharged through the overflow outlet 16 near the top of the water tank 12 results in the cooling water being coolest at the bottom of the water tank 12 and allows for the maximum overall heat transfer from the refrigerant to the cooling water.

The preferred embodiment of the invention has been shown to include a waste water reservoir 18 for collection and storage of the waste water, however, waste water after being collected may simply be directed into the tank without utilizing a separate storage container. In addition, one might simply employ a water jacket surrounding the motor-compressor and condenser coils passing either waste water or a combination of waste water and fresh water through the jacket from top to bottom. However, the latter system would not achieve as great a heat transfer efficiency as the present device.

I claim:

1. In a refrigeration system employing a motor-compressor and a coil of condenser tubing which produces waste water obtained either as meltdown water resulting from an ice making cycle or as condensate from a refrigerant evaporator, apparatus for utilizing such waste water comprising:

(a) a water tank to enclose said compressor and coil of condenser tubing, (b) an overflow conduit from said water tank located in the vicinity of the top of the compressor and the coil so the compressor and coil are immersed in water when the tank is full with water to the overflow conduit, (c) waste water supply means located above the overflow conduit of said water tank for the supply of said waste water, (d) a conduit to direct waste water from said waste water supply means to said water tank for cooling of the coil of condenser tubing and the motor-compressor

2. Apparatus as defined in claim 1, wherein said water tank additionally includes a fresh water inlet conduit connected to the tank for supplying fresh water thereto when insufficient waste water is available.

3. Apparatus as defined in claim 2, wherein said fresh water inlet conduit has a control valve connected to the condenser tubing for enabling emission of fresh water into the tank when the pressure of refrigerant rises above a predetermined value.

4. Apparatus as claimed in claim 1 wherein the coil of tubing extends downwardly about the compressor from a compressor discharge port and wherein the conduit to direct waste water is connected to the water tank near a lower end thereof.

* * * * *